United States Patent [19]

McVay et al.

[11] Patent Number: 4,593,743

[45] Date of Patent: Jun. 10, 1986

[54] CONTINUOUS CASTING APPARATUS HAVING OSCILLATOR FOR MOLD TUBE

[75] Inventors: James D. McVay, Youngwood; Hermann Take, Pittsburgh, both of Pa.

[73] Assignee: Continuous Casting Systems Inc., Pittsburgh, Pa.

[21] Appl. No.: 732,460

[22] Filed: May 9, 1985

[51] Int. Cl.[4] ..... B22D 11/04; B22D 11/124; B22D 27/08

[52] U.S. Cl. ..... 164/416; 164/443

[58] Field of Search ..... 164/416, 478, 260, 443

[56] References Cited

U.S. PATENT DOCUMENTS

| | | | |
|---|---|---|---|
| 3,782,446 | 1/1974 | Walter | 164/416 |
| 3,822,738 | 7/1974 | Rotarides et al. | 164/416 |
| 4,529,031 | 7/1985 | Scheinecker et al. | 164/416 X |

FOREIGN PATENT DOCUMENTS

| | | | |
|---|---|---|---|
| 0073670 | 3/1983 | European Pat. Off. | 164/416 |
| 2517227 | 6/1983 | France | 164/416 |
| 446352 | 10/1976 | U.S.S.R. | 164/416 |
| 605673 | 4/1978 | U.S.S.R. | 164/416 |
| 334758 | 11/1979 | U.S.S.R. | 164/416 |
| 904878 | 2/1982 | U.S.S.R. | 164/416 |

*Primary Examiner*—Nicholas P. Godici
*Assistant Examiner*—J. Reed Batten, Jr.
*Attorney, Agent, or Firm*—Fred Wiviott

[57] ABSTRACT

An oscillator for the mold tube of a continuous casting machine having a vertically oriented arcuate mold passage. The mold is mounted at the free end of a mold plate, the other end of which extends from the upper portion of a support frame. A vertical support is fixedly mounted adjacent the support frame and is coupled thereto by first and second links which respectively are pivotally connected at their opposite ends to the upper and lower portions of the vertical support and the support frame. An eccentric drive is mounted on the vertical support between the links and is coupled to the first link for oscillating the mold tube along the arcuate path defined by the mold tube passage.

6 Claims, 2 Drawing Figures

CONTINUOUS CASTING APPARATUS HAVING OSCILLATOR FOR MOLD TUBE

BACKGROUND OF THE INVENTION

This invention relates to continuous casting machines and more particularly to mold oscillating devices for such machines.

In conventional prior art continuous casting machines, molten metal is passed through an open ended flow through mold which may be curved or straight. The mold may also be vertically or horizontally oriented and is generally square or rectangular in shape but may be of various geometrical configurations. The mold which forms the metal strand confines the liquid metal and provides for its initial solidification, or formation of the encasing shell. The solidifying strand is extracted continuously from the bottom or exit end of the mold at a rate equal to that of the incoming liquid metal at the top or entrance end, the production rate being determined by the time required for the outer shell to harden sufficiently so as to contain the inner liquidus core by the time the strand exits the confines of the mold. In order to prevent the strand from adhering to the mold, it is a common practice to oscillate the mold along the path followed by the strand.

Prior art casting machines commonly employ an arcuate guide assembly located below the mold for receiving the strand as it exits the mold in a generally downward direction and for reorienting the strand into a generally horizontal path defined by the strand runout and cutting table. For this reason, continuous casting machines commonly employ a mold having an arcuate flow passage whose curvature comprises a continuation of the arcuate guide assembly. When such curved molds are employed, it is desirable to oscillate the mold along a path defined by the curvature of the guide assembly.

One type of prior art curved mold oscillating system employs relatively long pivoting lever arms and linkages coupled to an eccentric drive and to the mold. Such prior art mold oscillating systems required a substantial amount of space in the relatively crowded mold area. Another type of prior art mold oscillator was connected directly to the mold which tended to interfere with spraying systems employed for mold cooling.

SUMMARY OF THE INVENTION

It is an object of the invention to provide a new and improved mold oscillator for continuous casting machines.

Another object of the invention is to provide an oscillator for continuous casting machines which is relatively compact and inexpensive.

A further object of the invention is to provide an oscillator for continuous casting machines which permits cooling water spray nozzles to be positioned adjacent the outer surface of the mold.

These and other objects and advantages of the present invention will become more apparent from the detailed description thereof taken with the accompanying drawings.

In general terms, the invention comprises an oscillator for the mold of a continuous casting machine wherein the mold has a curved mold passage extending therethrough. The oscillator includes a fixed generally vertically oriented support and a generally vertically oriented support frame spaced from the support. The mold is mounted on the support frame with its passage oriented generally vertically. First and second link means respectively are coupled at their opposite ends adjacent the upper and lower ends of the support and the support frame. An eccentric drive means is mounted on the vertical support between the link means and is coupled to the first link means for oscillating the mold along the arcuate path defined by the mold passage.

DETAILED DESCRIPTION OF THE PREFERRED EMBODIMENT

Figure 1:
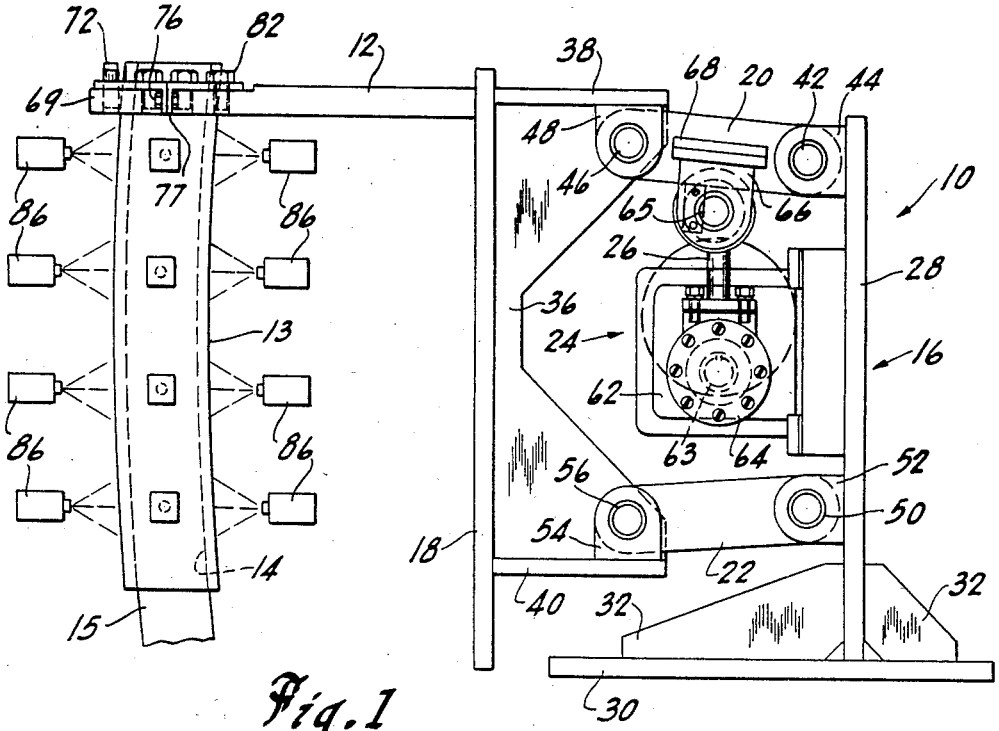
FIG. 1 is a side elevational view of the mold oscillator according to the invention.

FIG. 1 shows the mold oscillator 10 in accordance with the preferred embodiment of the invention. The mold oscillator 10 is coupled to a mold tube plate 12 from which a mold 13 is supported.

As those skilled in the art will appreciate, the mold 13 consists of a hollow tubular metallic member which defines a mold passage 14. In the illustrated example, the passage 14 is slightly arcuate with a center of curvature that defines the machine casting radius. As those skilled in the art will also appreciate, in the operation of a casting machine, molten metal will be delivered to the open upper end of the mold passage 14 from a tundish (not shown). As the molten metal passes through the mold passage 14, it will begin to solidify from its outer surface inwardly so that it will have a solidified skin and a molten core as it is withdrawn as a strand 15 from the lower end of mold passage 14 by a withdrawal and straightener assembly, which is not shown, but is well known in the art.

The oscillating mechanism 10 according to the invention is designed to oscillate the mold 13 along the arcuate path defined by the curvature of the mold passage 14. The oscillator includes a vertical support 16 and a generally vertically oriented mold support frame 18 which is spaced from the vertical support 16. A first pair of parallel links 20 are pivotally coupled at their opposite ends adjacent the upper ends of the vertical support 16 and the support frame 18 and a second pair of parallel links 22 are pivotally connected at their opposite ends adjacent the lower end of support 16 and the frame 18. The mold tube plate 12 is fixed at one end adjacent the upper end of the support frame 18 and at its other end to the mold 13. An eccentric assembly 24 is mounted on the vertical support 16 intermediate its ends and has a push rod 26 extending therefrom and being pivotally connected to the links 20.

The support 16 includes a vertical plate 28 secured to and extended perpendicularly from a base plate 30 which is mounted on the casting platform (not shown) of the continuous casting machine support structure and preferably in such a manner that the support 16 is positioned on the operator's side of the mold tube plate 12. A plurality of generally triangular ribs 32 are fixed to the base plate 30 and to the opposite sides of the plate 28 to provide additional reinforcement. The support frame 18 also includes a vertically extended plate 34 which has a pair of horizontally spaced apart generally vertically oriented mounting plates 36 fixed along its lateral edges and extending toward the support 16. In addition, top and bottom plates 38 and 40 are secured along one edge to the plate 18 and also bridge the gap between the upper and lower edges of the plates 36. The plates 36 also have a cut-out in their trailing edges to accommodate the eccentric assembly 24.

The links 20 are pivotally connected by pins 42 at one end to pairs of brackets 44 fixed to the front face of vertical plate 28 and in alignment with each other. The opposite ends of links 20 are similarly pivotally connected by pins 46 to pairs of aligned brackets 48 fixed to the under surface of top plate 38. The lower links 22 are likewise pivotally connected at one end by pins 50 to pairs of brackets 52 fixed to plate 28 below brackets 44 and in alignment with each other and that their opposite ends by pins 56 to pairs of aligned brackets 54 fixed to the upper surface of the lower plate 40 and vertically below brackets 48.

Eccentric assembly 24 includes a drive motor 58 mounted on the front of plate 28 by mounting pads 60 and 61 and a U-shaped collar 62. The motor 58 has a drive shaft 63 which is eccentrically connected to a crank 64. The crank 64 in turn is connected to the push rod 26 which is pivotally coupled by pin 65 to brackets 66 connected to the under surface of a cross member 68 fixed to and extending between the links 20. It will be appreciated that when the motor 58 operates, the push rod 26 will be moved in an eccentric path and also reciprocate vertically to move the links 20, and consequently the frame 18, in a vertical arcuate path such that the mold 13 will reciprocate in the arcuate path defined by the mold passage 14.

Figure 2:
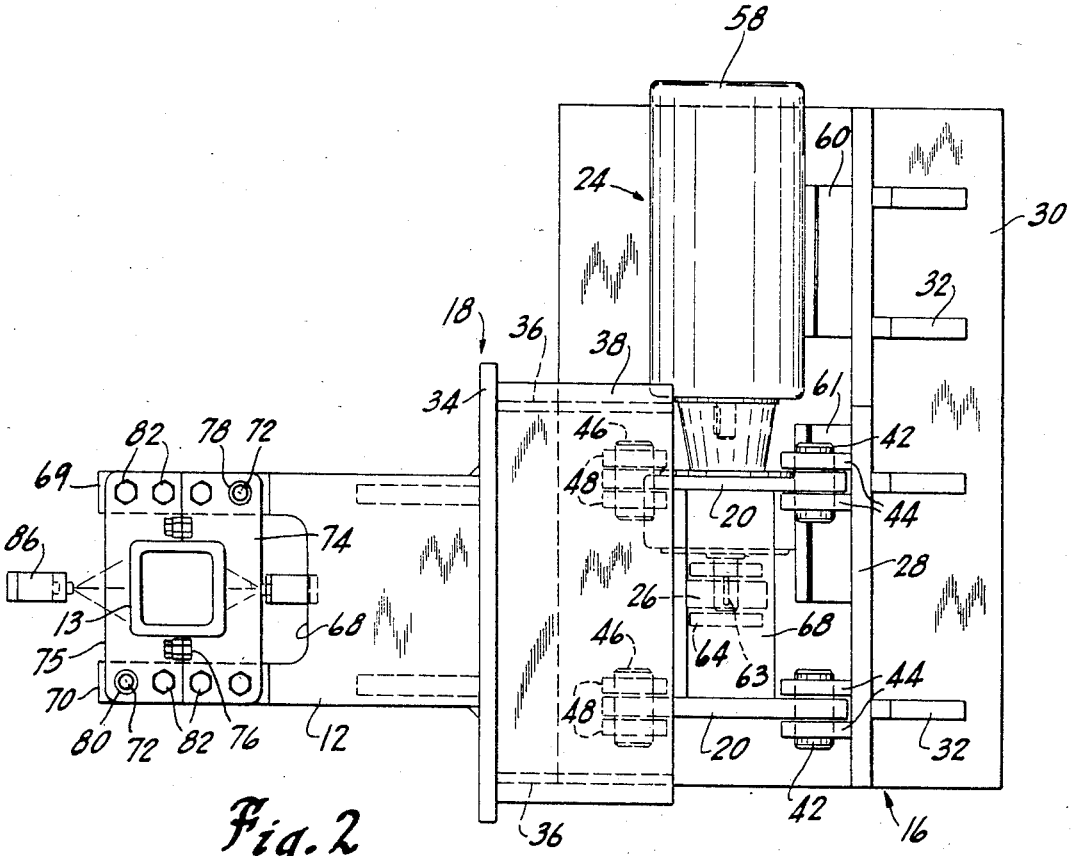
FIG. 2 is a top plan view of the mold and oscillator shown in FIG. 1.

As seen particularly in FIG. 2, the mold tube plate 12 comprises a relatively flat member having a U-shaped cut-out 68 at its free end to define a pair of forwardly projecting fingers 69 and 70. The fingers 69 and 70 are shown in FIG. 1 to be of reduced thickness and each has an upwardly extending alignment pin 72. One alignment pin 72 is at the inboard end of finger 69 and the other is at the free end of finger 70. The mold 13 is mounted on plate 12 by means of a pair of opposed, U-shaped mounting brackets 74 and 75 each configured to receive one side of the mold 13. The brackets 74 and 75 are received in a peripheral groove formed around the upper end of the mold 13 and are joined by bolts 76 extending through holes in mating flanges 77 extending downwardly from each bracket 74 and 75. By properly tightening the bolts 76, the mold can be placed in compression to provide a rigid coupling. Each of the brackets 74 and 75 has an opening 78, 80 which is complementary to one of the alignment pins 72. In addition, there are a plurality of bolts 82 extending downwardly through aligned openings in the brackets 74 and 75 and threaded holes in the fingers 69 and 70 for releasably securing the mold 13 to the plate 12. Because the oscillator assembly 10 is connected to the mold at its upper end, the entire outer surface of the mold is unobstructed to permit cooling in any convenient manner, such as by water spray nozzles 86.

While only a single embodiment of the invention is illustrated and described, it is not intended to be limited thereby, but only by the scope of the appended claims.

We claim:

1. A continuous casting apparatus comprising:

a mold tube having a vertically oriented arcuate mold passage, a mold tube mounting plate, said mold tube being mounted at one end of said mold tube mounting plate, a fixed support having upper and lower portions, support frame means spaced horizontally from the fixed support and having upper and lower portions, and first and second sides, said mold tube mounting plate being fixed to the first side of said support frame means, first linkage means pivotally connected to the upper portions of the fixed support and the support frame means and second linkage means pivotally connected to the lower portions of the fixed support and the support frame means, the first and second linkage means being connected to the second side of said support frame means, an eccentric drive means disposed between said first and second linkage means and coupled to said first linkage means for oscillating said mold tube in an arcuate path defined by the mold passage.

2. The continuous casting apparatus set forth in claim 1 and including spray means surrounding said mold tube for spraying cooling water thereon.

3. The continuous casting apparatus set forth in claim 1 wherein said eccentric drive means is mounted on said fixed support.

4. The continuous casting apparatus set forth in claim 3 wherein said mold tube mounting plate extends generally horizontally and is connected to the upper end of said mold tube.

5. The continuous casting apparatus set forth in claim 4 wherein said mold tube mounting plate is recessed for receiving said mold tube, alignment means on said mold tube and said plate for mounting said mold tube on said mounting plate in proper alignment, and means for releasably securing the mold tube to the mounting plate.

6. The continuous casting apparatus set forth in claim 5 wherein said eccentric drive means comprises motor means mounted on said fixed support and push rod means coupled to said first linkage means intermediate its ends, said push rod means being pivotally connected to said first linkage means and eccentrically connected to said motor means.

* * * * *